US006272951B1

(12) United States Patent
Lambson

(10) Patent No.: US 6,272,951 B1
(45) Date of Patent: Aug. 14, 2001

(54) JOIST HANGER MOUNTING TOOL

(76) Inventor: Michael L. Lambson, 220 Pike St., Crescent City, CA (US) 95531

( * ) Notice: Subject to any disclaimer, the term of this patent is extended or adjusted under 35 U.S.C. 154(b) by 0 days.

(21) Appl. No.: 09/546,699

(22) Filed: Apr. 10, 2000

(51) Int. Cl.[7] ..... B25C 3/00
(52) U.S. Cl. ..... 81/44; 81/488; 269/3; 269/41
(58) Field of Search ..... 81/44, 180.1, 484, 81/488; 269/3, 41, 904

(56) References Cited

U.S. PATENT DOCUMENTS 5,054,755 10/1991 Hawkes ..... 269/3
5,312,095 5/1994 Rennie ..... 269/41
6,126,156 * 10/2000 Brodeur ..... 269/41

* cited by examiner

*Primary Examiner*—Joseph J. Hail, III
*Assistant Examiner*—David B. Thomas
(74) *Attorney, Agent, or Firm*—James D. Givnan, Jr.

(57) ABSTRACT

A hanger installing tool includes a pair of slidably mounted posts and an impact member for the driving of prongs of a joist hanger into a header. Arm members of the tool position the tool vertically on a header side with retainers on the arm members confining the tool in header engagement. Limit stops on the tool position an inserted hanger into place on the tool. A bracket attachable to the tool provides one of multiple limit stops for hangers of various lengths. A shoulder on the tool is abutted by the upper end of a hanger to contribute to proper hanger installation. Opposed surface of the tool are engaged in a biased manner by angular flanges of the hanger providing hanger retention during header attachment. Threaded sockets permit selective attachment of a tool handle to best serve convenient use of the tool.

15 Claims, 3 Drawing Sheets

6
3
2
6
3
4
4
21
5
31
14
5
17
10
21
1
11
7
7
6
8
11
7
11
7A
9
32

FIG. 3
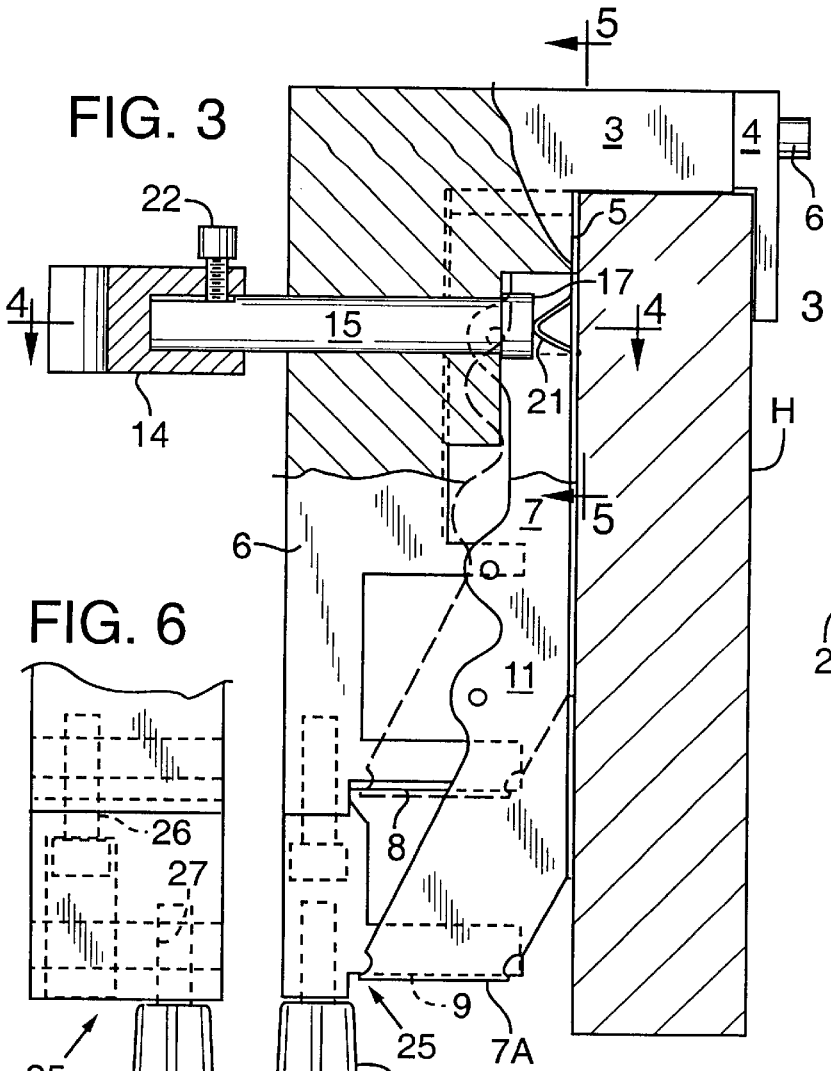
FIG. 6
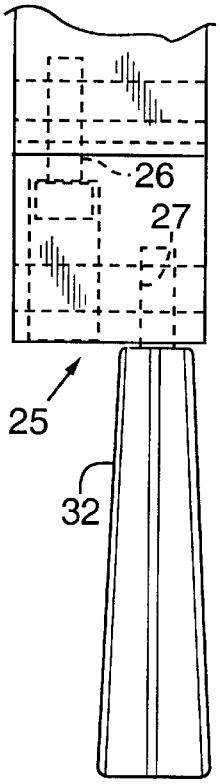
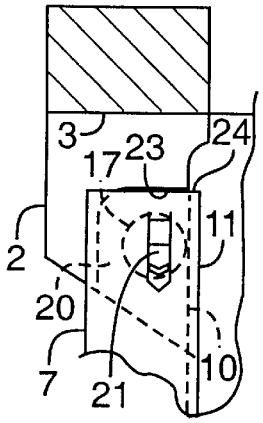
FIG. 5
FIG. 4
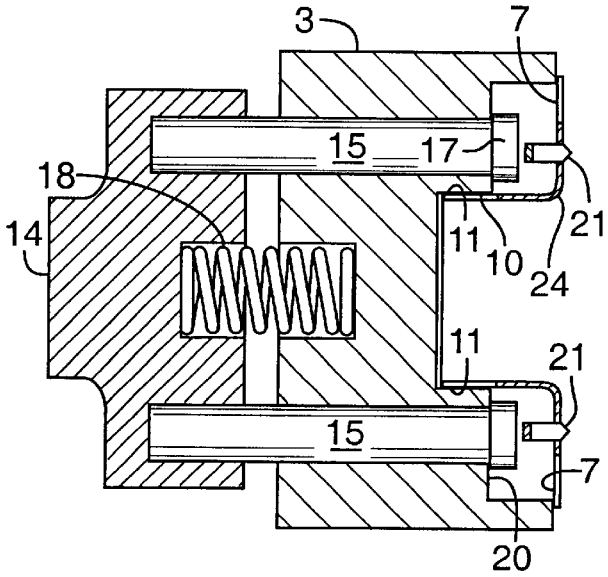

JOIST HANGER MOUNTING TOOL

BACKGROUND OF THE INVENTION

The present invention is concerned with the installation of hangers for the attachment of the ends of joists to a header beam.

Hangers are used in building construction for securing the ends of joists to the sides of a single beam, termed a header, with a problem being encountered in achieving joist attachment in a rapid, uniform and precise manner. Irregularities in such attachment result in a floor or roof structure being other than level and of less than optimum strength. A further problem encountered in the securing joists to a header beam is the time spent by a the worker in the positioning and subsequent attachment of a hanger, in the vertical, to the header. It is common practice to use a square or level for marking the header prior to hanger attachment. Needless to say such added effort when totaled amounts to considerable time in view of the fact that several hangers are usually attached to a single header in the construction of a typical home or frame building. Hangers incorrectly set entail further time consuming efforts.

In the prior art efforts to facilitate the attachment of hangers to headers has included the tool disclosed in U.S. Pat. No. 5,054,755, in which a hanger is installed and retained during affixing of the hanger to a header using a hammer to drive hanger prongs into the header. The tool defines a slot in which the web of a U-shaped hanger is initially inserted. The tool is then manually abutted against the header and retained in place by a spring biased clamp. With the hanger and tool in place on the header a second operation involves hammering the hanger prongs in the usual fashion into the header. A degree of difficulty is encountered by reason that the user must accomplish driving hanger prongs located closely adjacent to the sides of the tool without contact with and displacement of the tool and hanger. Further, the temporary installation of the tool on a header utilizes a spring biased clamp may be susceptible to permitting displacement of the tool during hammering resulting in a mis-mounted hanger being out of the vertical. For one reason or another the tool disclosed to the extent known, appears to not have found wide acceptance.

U.S. Pat. No. 5,312,095 discloses a tool for attaching a hanger onto a header for subsequent installation of joists with the tool including an angular, upward extending rod which is adjustable to support the tool at different distances from the upper edge of the header. A hanger is slid into place within vertical slots of the tool followed by nailing of the hanger flanges to the header. A web portion of the hanger is carried within a slot in the tool main body. Securement of the hanger to a header is by nailing which is typical of hanger installation.

SUMMARY OF THE INVENTION

The present invention is embodied in a tool in which a hanger may be loaded and subsequently secured to a header or other beam.

A main body of the tool is initially supportedin a secure manner on the top edge of a header. A hanger of U-shape, previously installed in the tool, is attached to the header upon a hammer blow or blows being imparted to slidably mounted impact members of the tool. Ends of the impact members drive prongs on the hanger into the header. During such driving the tool is stabilized by main body arms in place on the header as well as a handle permitting stabilizing of the tool in place against the side of the header. Accordingly the hanger is always attached in the vertical to a horizontal header and at a pre-determined elevation on the header. Use of supplementary tools for insuring vertical positioning of the hanger may be dispensed with. Multiple attachment positions of the tool handle permits tool use on floor and ceiling headers in a convenient manner and in locations where the tool is best supported from one side or the other. One or more limit stops enable installation of different lengths of hangers.

Important objectives of the present invention include the provision of a tool for momentary secure placement on a header to ensure vertical installation of a hanger carried by the tool; the provision of a tool adaptable to use in attaching hangers to headers of different widths and heights; the provision of a tool which both positions a hanger on the side of a header and permits attachment of the hanger without risk of injury or hanger displacement during the delivering of impact blows to the tool; the provision of a tool for installing hangers which greatly facilitates hanger installation to floor and ceiling headers for considerable cost savings to the contractor; the provision of a tool for installing hangers of a range of sizes to accommodate joists of unusual height; the provision of a hanger installation tool with multiple limit stops for proper positioning of a hanger on the tool.

BRIEF DESCRIPTION OF THE DRAWINGS

In the accompanying drawings:

FIG. 3 is a side elevational view on a hanger and showing a modified form thereof for installing hangers of greater than usual height;

FIG. 4 is a horizontal, sectional view taken substantially along line 4—4 of FIG. 3;

FIG. 5 is a vertical section taken above line 5—5 of FIG. 3;

FIG. 6 is a fragmentary front elevational view of FIG. 3.

DETAILED DESCRIPTION OF THE PREFERRED EMBODIMENTS

Figure 1:
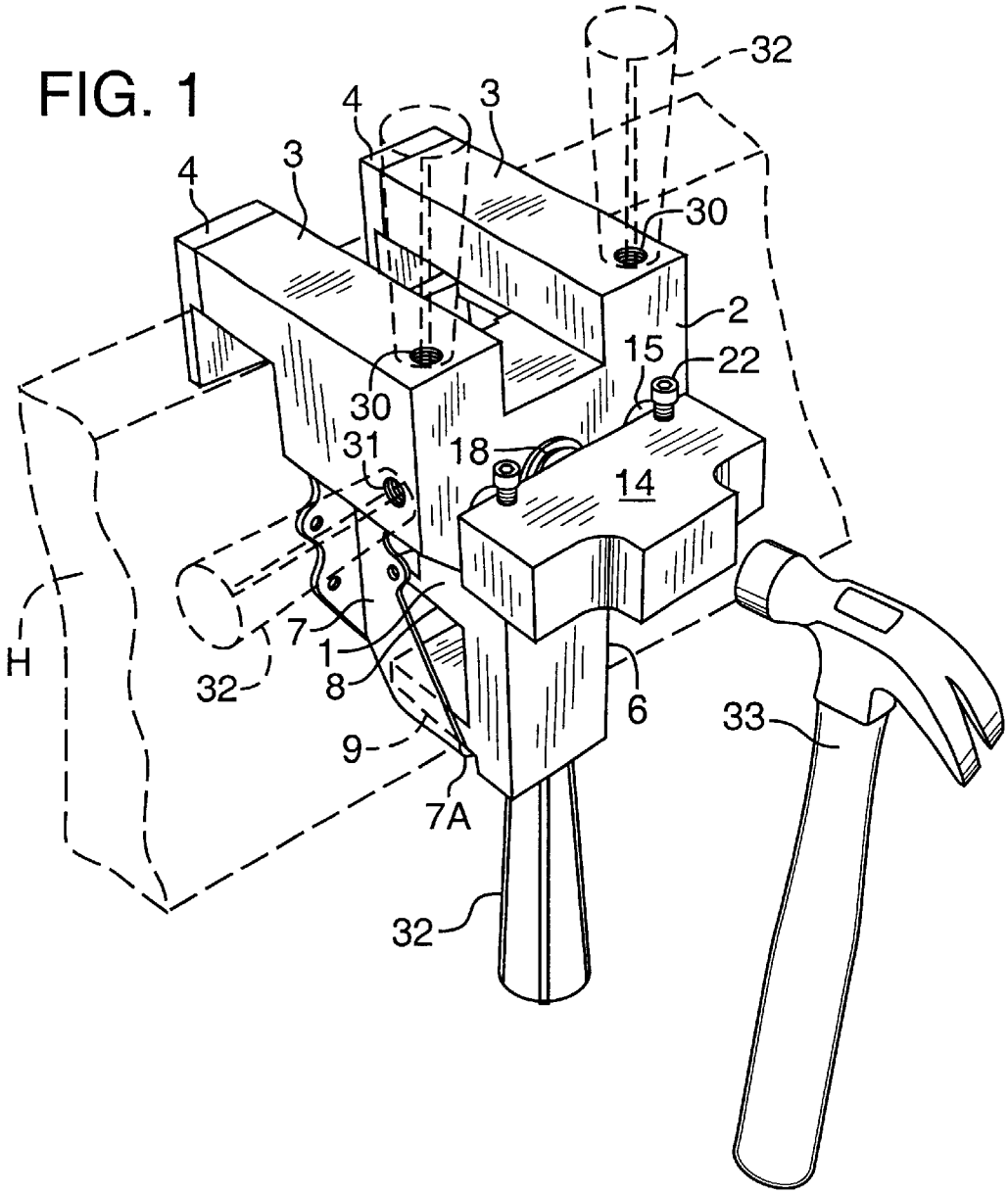
FIG. 1 is a downward perspective view of the tool in place on a header shown in broken lines.
Figure 2:
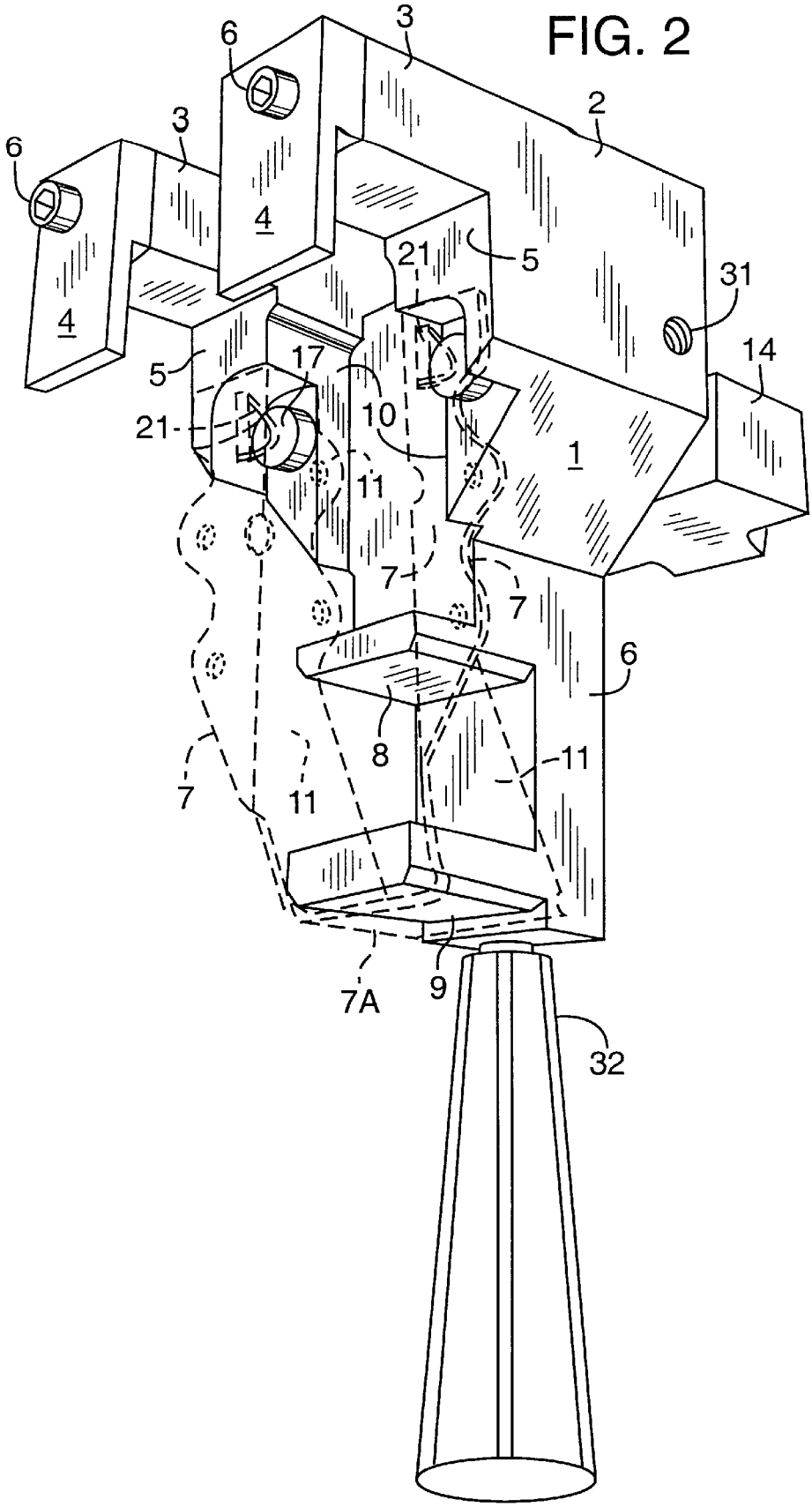
FIG. 2 is an upward perspective view from the header engaging side of the tool with a hanger installed in the tool and shown in broken lines.

With continuing attention to the drawings wherein reference numerals indicate parts similarly hereinafter identified, the reference numeral 1 indicates a main body of the tool having a head portion 2 with forwardly projecting arms 3 for rested engagement with the upper edge of a header indicated at H in FIG. 1.

Retainers at 4 on the arms confine the tool against fore and aft displacement in conjunction with wall surfaces at 5 on the main body. Fasteners at 6 permit retainer removal and substitution of retainers providing less or greater span between each retainer 4 and a surface 5 to adapt the tool to headers of different widths.

A downward extension at 6 of main body 1 is of reduced width and receives a hanger 7 with a web 7A in place across a stop surface 9 of the main body. An upwardly spaced stop surface 8 on the body is provided for receiving the web of a hanger of lesser length. Per FIG. 5 hanger retention on the tool is facilitated by opposed surfaces at 10 of the tool main body abutted by the outer surfaces of angular flanges as at 11 of the hanger. Surface engagement of the hanger and tool surfaces 10 during loading of the tool is somewhat biased in view of the upwardly divergent flanges 11 as manufactured and the inherent flexibility of the hanger.

Hammer means are carried by main body 1 and include a block 14. Posts at 15 (FIG. 3) within bores as at 16 each terminate forwardly in an impact member 17. A compression spring at 18 (FIG. 4) locates impact member 14 away from the main body seating members 17 against a wall 20 on body 1. A hanger to be installed is positioned within the tool with its web 7A in place against limit stop surface 9 or 8 which positions the hanger prongs at 21 immediately forward of impact members 17 for prong displacement upon an impact blow or blows being imparted to block 14. Set screws at 22 secure block 14 to posts 11 slidably carried by the head. Positioning of the hanger on the tool is additionally aided by the location of limit stop as at 23 against which the radiussed comers 24 of the angular flanges 11 seat.

In FIGS. 3, 5 and 6 a modification of the present tool is shown for the installation of longer than typically used hangers with the modification including a bracket generally at 25 countersunk to receive a machine screw 26 in upward threaded engagement with head extension 6. The bracket is provided with a threaded socket at 27 for purposes of attachment of a handle 32 of the tool. Various handle attachment points are provided as at 30–31 on main body 1 to permit tool use in a convenient manner on elevated headers as well as floor headers. In the latter instance the handle at 32 would be threaded into one of the threaded sockets 30. Similarly tool use adjacent corners of a floor or ceiling structure may be facilitated by horizontal or side located threaded openings as at 31 in the main body. In a typical hanger installation and somewhat dependent on the density of the header wood, a hanger may be installed by one or two blows from a hammer 33 with the prongs 21 being set to hold the hanger in position while other fasteners are applied.

In using the tool, a hanger sized for the joist being installed is grasped with one hand and inserted into the tool. As most hangers are somewhat of upwardly divergent shape to enable the manufacturer to ship large quantities of hangers in a compact, nested collection the hanger may require slight manual inward repositioning of the angular flanges 7 toward one another. Such displacement of the flanges results in the flanges, when in place in the tool, exerting an outwardly or laterally directed biasing force which ensures retention of the flanges 11 against the opposing surfaces 10 of the tool. The tool is then abutted against the side of the header with arms 3 thereon followed by driving of block 14. Subsequent to prong insertion additional fasteners may be driven to complete hanger installation.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A tool for installing a hanger having sides with prongs thereon and a web between the sides on a header for the attachment of a joist at a right angle to the header, said tool including, a main body including arm means for placement on the top edge of the header hammer means slidably mounted on the main body and including a block and impact members driven by said block for contact with the hanger prongs, a handle on said main body, and hanger engaging opposed surfaces on the main body for positioning and retention of the hanger with the prongs thereon proximate said impact members.

2. The tool claimed in claim 1 wherein said opposed surfaces are spaced at a distance less than the horizontal distance between the sides of the hanger to enable biased engagement of the hanger sides with said opposed surfaces, upon flexing of the hanger sides, to retain the hanger in place on the tool during hanger installation on the header.

3. The tool claimed in claim 1 wherein said main body includes multiple threaded sockets for selective attachment of said handle.

4. The tool claimed in claim 1 additionally including a spring biasing said hammer means toward a static position.

5. The tool claimed in claim 1 wherein said main body additionally includes limit stop means for abutment with a hanger.

6. The tool claimed in claim 5 wherein said limit stop means is located at an extremity of said main body.

7. The tool claimed in claim 6 wherein said limit stop means includes a bracket removably mounted on said main body.

8. The tool claimed in claim 5 wherein said limit stop means includes a shoulder proximate said hanger engaging opposed surfaces on the main body.

9. A hand tool for installing a hanger on a header beam for supporting an end of a joist, said tool including, a main body positionable against one side of the header, hammer means slidably mounted on the main body and including impact members for driven contact with the hanger, and hanger engaging means on the main body for retention of the hanger on the main body during hanger installation on the header.

10. The tool claimed in claim 9 wherein said main body additionally includes support means for rested engagement with the header.

11. The tool claimed in claim 10 wherein said support means includes a retainer for contact with another side of the header.

12. The tool claimed in claim 11 additionally including fastener means attaching said retainer in a detachable fashion to accommodate tool engagement with headers having a range of thicknesses.

13. The tool claimed in claim 9 wherein said hammer means includes a pair of posts, a block coupled to said posts for receiving force applied to the tool during hanger attachment to the header.

14. The tool claimed in claim 9 wherein said main body includes a limit stop against which a hanger is abutted during hanger attachment to the tool.

15. The tool claimed in claim 14 wherein said main body includes an additional limit stop on the main body against which a hanger is abutted during hanger attachment to the tool.

* * * * *